United States Patent [19]

Chang

[11] Patent Number: 4,693,285

[45] Date of Patent: Sep. 15, 1987

[54] AUTOMATIC CONTAINER-FILLING APPARATUS

[76] Inventor: Hong-Tsuan Chang, No. 83, Sec. 2, Ling Sangh Road, Tainan, Taiwan

[21] Appl. No.: 907,384

[22] Filed: Sep. 15, 1986

[51] Int. Cl.[4] ..... B65B 3/06

[52] U.S. Cl. ..... 141/71; 141/94; 141/83; 141/155

[58] Field of Search ..... 141/1-12, 141/71-83, 98, 250-284, 129-191, 94, 99, 96

[56] References Cited

U.S. PATENT DOCUMENTS 4,537,229 8/1985 Sashiki et al. ..... 141/83

4,559,981 12/1985 Hirano ..... 141/83

*Primary Examiner*—Houston S. Bell, Jr.

*Attorney, Agent, or Firm*—Cushman, Darby & Cushman

[57] ABSTRACT

An automatic container-filling device for filling solid foodstuff into containers includes: apparatus for feeding solid foodstuff into the automatic container-filling device; apparatus for directing the flow of the solid foodstuff to a predetermined position, including a plurality of parallel solid foodstuff flow paths each of which is connected by a vibrating inclined channel with a flow control valve set, a collecting basket functionally connected to a load cell, and a funnel; apparatus for transporting the containers to beneath the funnels; apparatus for transporting the containers filled with a predetermined amount of the solid foodstuff out of the automatic container-filling device, and an automatic control system including a CPU (central processing unit) for controlling the entire filling process from entrance of the solid foodstuff and containers into the automatic container-filling device to exit from the automatic container-filling device of the containers filled a predetermined amount of the solid foodstuff. The load cells, the collecting baskets, and the flow control valve sets are provided for automatic accurate metering of the solid foodstuff.

18 Claims, 6 Drawing Figures

AUTOMATIC CONTAINER-FILLING APPARATUS

BACKGROUND OF THE INVENTION

The invention relates to a filling device for filling solid foodstuff into containers, particularly to an automatic container-filling device with continuous automatic control for transporting the solid foodstuff to a predetermined position, transporting the containers to another predetermined position, filling accurately the containers with a predetermined amount of solid foodstuff, and transporting the containers filled with a predetermined amount of the solid foodstuff out of the device.

Generally, solid foodstuffs such as peanuts, mushrooms, bamboo shoots, and the like, are filled by hand into containers such as cans and bottles. This is too slow for modern mass production. Furthermore, for manual filling it is necessary that the containers be vibrated so as to be filled up. If the containers be made of glass, the containers may break during vibration and their fragments mix in the solid foodstuff. In addition to manual filling of the containers, the conventional metering of solid foodstuff is also achieved manually. This manual metering is not only slow, but also inaccurate. Although an arrangement has been achieved whereby containers are conveyed beneath a feeding assembly filled with solid foodstuff, solid foodstuff in sheets with a relatively large surface area are difficult to be conveyed because they easily attaches to the conveyors.

SUMMARY OF THE INVENTION

An object of the invention is to provide an automatic container-filling device for handling solid foodstuff, which can fill containers smoothly, rapidly and accurately.

Another object of the invention is to provide an automatic filling device for solid foodstuff, which has continuous automatic control from entrance into the device of the solid foodstuff and the containers, to exit from the device of the containers filled with a predetermined amount of the solid foodstuff.

According to the invention, an automatic container-filling device for solid foodstuff includes: means for feeding the solid foodstuff from the exterior of the device to the interior of the device; means for directing the flow of the solid foodstuff, including a movably mounted inclined channel for transporting said solid foodstuff fed from the solid foodstuff feeding means, a flow control valve set disposed on the channel for controlling the flow quantity of the solid foodstuff through the channel, a collecting basket provided for collecting the solid foodstuff dropped from the channel and having an openable bottom gate which is disposed at a bottom of said basket and which is controlled by an electro magnetic valve, a load cell functionally connected to the basket for measuring and indicating the weight of the solid foodstuff contained in the basket, a funnel for collecting the solid foodstuff dropped from the basket, and a rotating stand for mounting and rotating the funnel; means for vibrating the channel to move the solid foodstuff downward along the channel; means for transporting containers to beneath the funnel to receive the solid foodstuff dropped from the funnel, and subsequently transporting the containers filled with a predetermined amount of the solid foodstuff out of the container-filling device; and an automatic control system, including a CPU (central processing unit) for controlling the timing of the action of the flow control valve, the load cell and the openable bottom gate of said basket; whereby, when the solid foodstuff and the containers are fed into said container-filling device, the predetermined amount of said solid foodstuff is poured respectively into each of said containers by the timing control of the automatic control system, and then the containers filled with the predetermined amount of the solid foodstuff will be transported out of said container-filling device.

Furthermore, in order to speed up the filling procedure, a plurality of parallel solid foodstuff flow paths are provided, each of which includes the channel, collecting basket and the funnel.

DETAILED DESCRIPTION OF THE PREFERRED EMBODIMENTS

Figure 1:
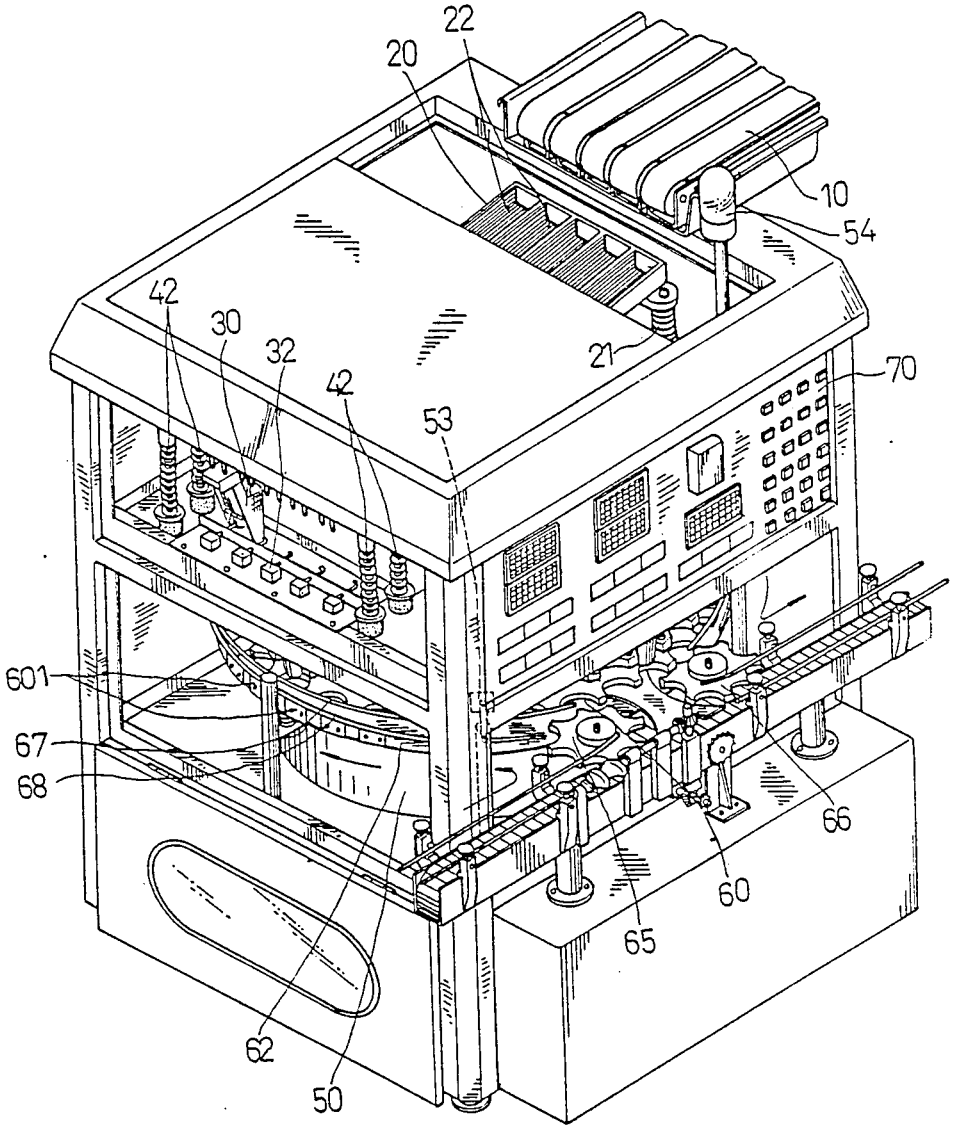
FIG. 1 is a perspective view showing an automatic container-filling device for solid foodstuff according to the invention.
Figure 2:
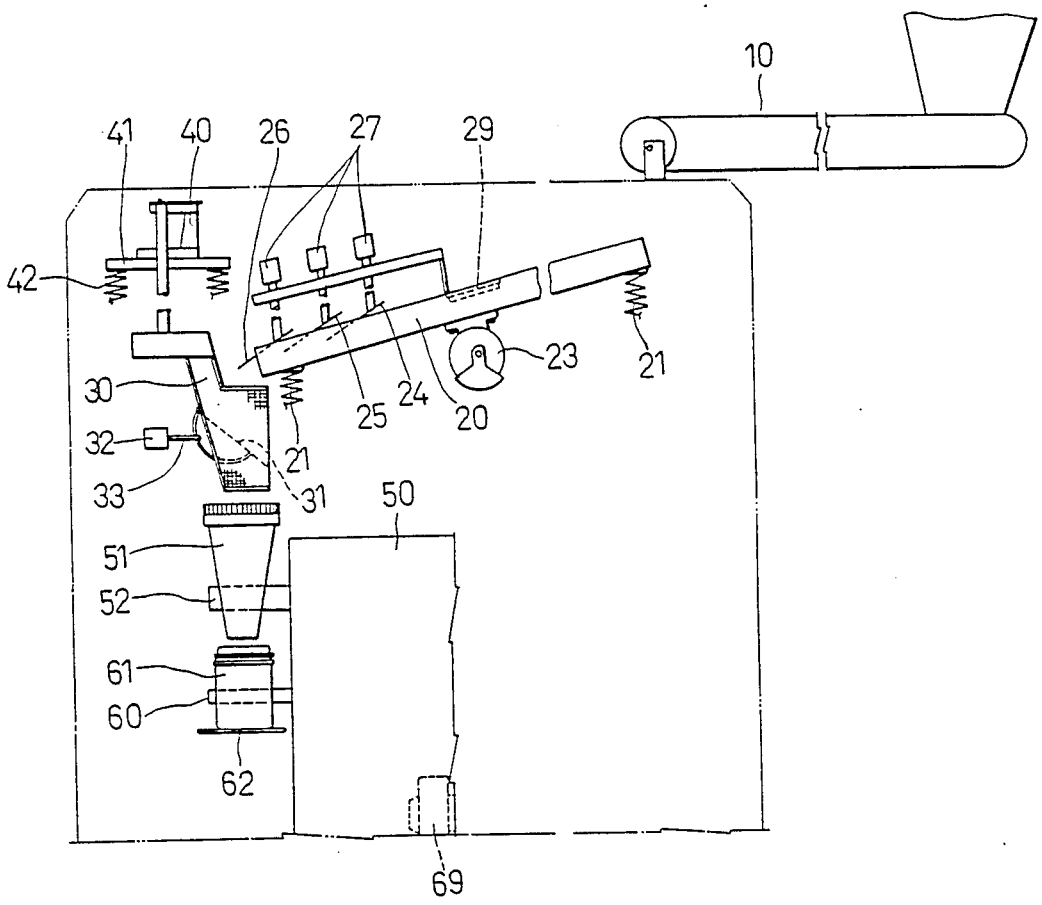
FIG. 2 is a schematic side view showing the automatic container-filling device of FIG. 1.

Referring to FIGS. 1 and 2, an automatic container-filling device for solid foodstuff according to the invention includes: means for feeding the solid foodstuff into the filling device, means for directing the flow of the solid foodstuff fed from the solid foodstuff feeding means to a predetermined position to pour the solid foodstuff, means for transporting containers to beneath the predetermined position and subsequently for transporting the containers out of the container-filling device after filling, and an automatic control system.

The means for feeding solid foodstuff into the filling device includes five parallel conveyor belts 10, and five first motors (not shown) adapted to drive respectively the conveyor belts 10 (see FIGS. 1 and 2).

Figure 3:
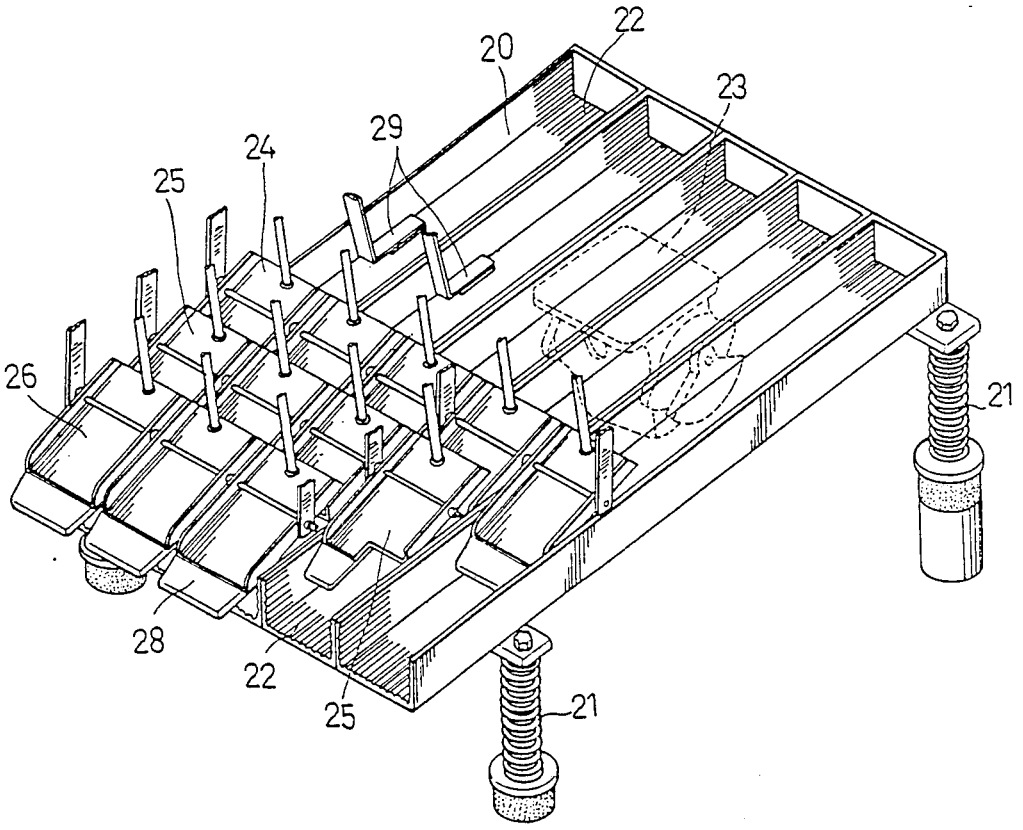
FIG. 3 is a perspective view showing five parallel solid foodstuff channels of the automatic container-filling device of FIG. 1.
Figure 4:
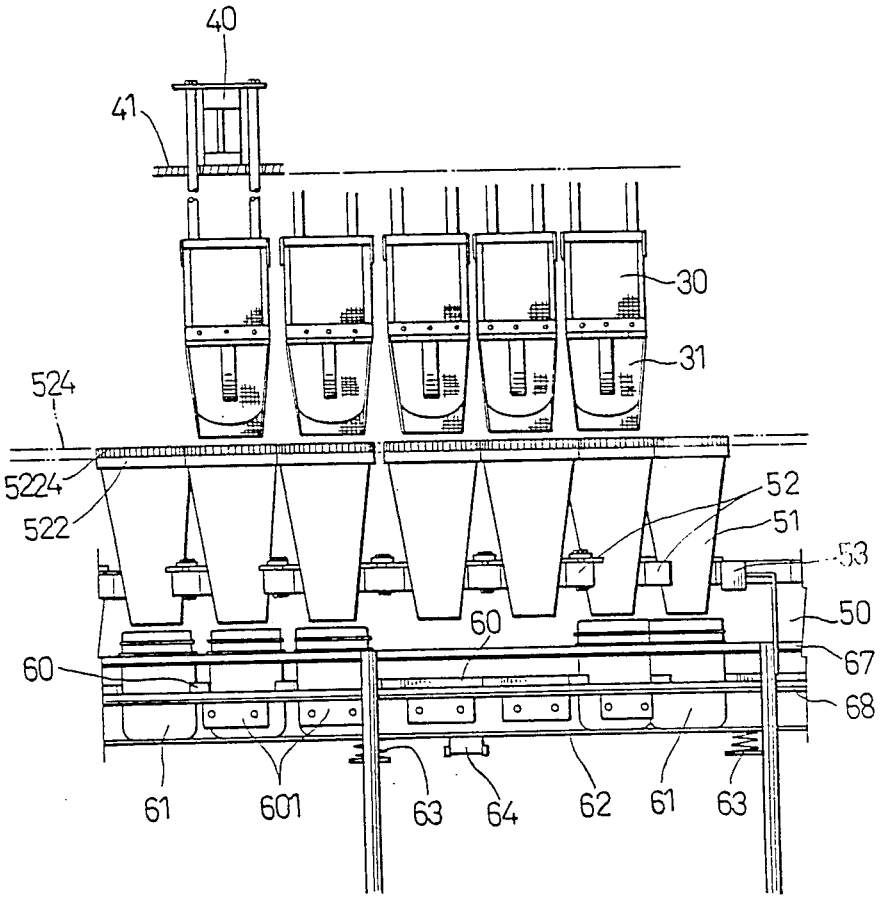
FIG. 4 is a rear partial view showing the automatic container-filling device of FIG. 1.

The means for directing the flow of the solid foodstuff includes: five parallel inclined channels 20 for transporting the solid foodstuff, as shown in FIG. 3, each respectively movably supported below the output ends of the five conveyor belts 10 by the first springs 21 so as to receive the solid foodstuff dropped from the output ends of the conveyor belts 10, each of the channels 20 including a lower outlet and a flow control valve set; five net collecting baskets 30 for collecting the solid foodstuff dropped from the lower outlets of the channels 20, each including an upper opening (see FIG. 2) of larger size than that of the outlet of the channels 20, and an openable bottom gate 31 disposed at a bottom of the basket 30 and controlled by a first electro magnetic valve 32, and a valve rod 33; five load cells 40, respectively mounted on a support plate 41 biased by second springs 42, and connected functionally to the baskets 30 for respectively measuring and indicating the weight of the solid foodstuff contained in each of the baskets 30; a rotating stand 50, driven to rotate by a second motor (not shown) disposed below the rotating stand 50; a plurality of funnels 51, mounted securely on the rotating stand 50 by a funnel fixing frame 52, spaced apart equally from each other and capable of simultaneously opposing the five baskets 30 after they are rotated to beneath the five baskets 30, respectively having an upper opening of larger size than that of the openable bottom gates 31 of the baskets 30 for collecting the solid foodstuff dropped from the baskets 30; a counter 53, as shown in FIGS. 1 and 4, fixed near the rotating stand 50 and flush with the funnels 51 for detecting, totaling and indicating the number of the funnels 51 which are carried by the rotating stand 50 to pass through the front of the five baskets 30 (at left end of FIG. 4); and an alarm lamp 54 (see FIG. 1) disposed a top portion of the filling device for generating an audio-video alarm signal when the rotating movement of rotating stand 50 is stopped for a predetermined period. The net structure of the basket 30 is prevented from the attachment of wet solid foodstuffs thereon.

Referring to FIGS. 2 and 3, each of the channels 20 includes a ribbed inner surface 22 for preventing attachment of the solid foodstuff thereon when the surface area of the solid foodstuff is large. Below the channels 20 is a first vibrator 23, as shown in FIG. 2, for vibrating the channels 20 to move the solid foodstuff downward along the channels 20. The flow control valve set includes a front valve gate 24 which is normally wholly closed, an intermediate valve gate 25 which is normally partly closed, a rear valve gate 26 which is normally wholly closed and three second electro magnetic valves 27 respectively connected to the valve gates 24, 25 and 26 for controlling the valve gates, to control accurately the flow of the solid foodstuff through the channels 20. Below the valve gates 24, 25 and 26 are rubber pieces 28 to act as a chushion for vibration of the first vibrator 23 so as to ensure accurate flow control of the solid foodstuff. Additionally, in each solid foodstuff flow path the channel 20 is provided with a solid foodstuff level controller 29 which is connected functionally to the first motor adapted for driving the conveyor belt 10. When the flow level of the solid foodstuff exceeds a predetermined level through the channel 20, the solid foodstuff level controller 29 will output a signal for stopping the rotation of the first motor 23 and hence the conveyor belt 10 to prevent blockage of the solid foodstuff in the channels 20.

The means for transporting the containers includes an large rotating wheel 60, mounted securely on the rotating stand 50 for synchronous rotation with the funnels 51, provided with consecutive curved hemispherical identations spaced apart equally from each other at a same distance as that between the funnels 51 for retaining a part of the containers 61 within the identations; an vibrating plate 62 with a smooth upper surface for placing the containers 61 thereon, supported by third springs 63 and vibrated by a second vibrator 64; an container input small rotating wheel 65 for inputing of the containers 61 in a direction as the arrow show in FIG. 1, rotated by a third motor (not shown), shaped in a similar form to that of the container holding frame 60 but of a smaller diameter than that of the frame 60; a container output small rotating wheel 66 for outputing of the containers 61 in a direction as the arrow show in FIG. 1, rotated by a fourth motor (not shown), also shaped in a similar form to the container input rotating wheel 65 and the same size as the container input rotating wheel 65; an upper and a lower block rod 67, 68, surrounding the large rotating wheel 60 in cooperation with the large rotating wheel 60 for holding the containers 61 to receive the solid foodstuff dropped from the funnel 52 and guiding the containers 61 to move annularly; a clutch brake 69 (see FIG. 2) for stopping the rotation of the rotating stand 51; and five electric eyes 601, as shown in FIG. 4, fixed on the lower block rods 68 for respectively sensing any absence of a corresponding container 61 beneath a corresponding baskets 30 and sending a signal to prevent the opening of the openable bottom gate 31 of the corresponding basket 30.

The automatic control system includes primarily a CPU having a EPROM and adopting the C20 program control designed by Japan OMROM company for controlling the action of the valve gates 24, 25, 26, the conveyor belts 10, the clutch brake 68, the load cells 40, the openable bottom gates 31 of the baskets 30, the counter 53, the electric eyes 601 and the alarm lamp 54. The automatic control system is controlled through a plurality of push bottons 70, as shown in FIG. 1.

Figure 5:
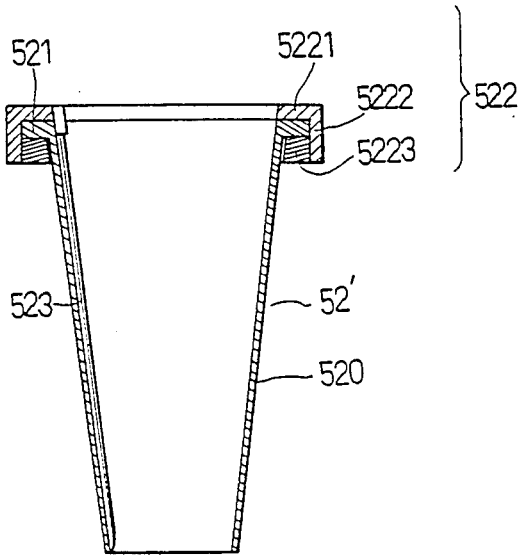
FIG. 5 is a sectional view showing a funnel of the automatic container-filling device according to the invention.

Referring to FIG. 5, a funnel 52' according to the invention includes a funnel body 520 with an upper flange 521; a rotary ring member 522, including an upper ring 5221 disposed above the flange 521, a side ring 5222 integrated with the upper ring 5221 at the top end and surrounding the flange 521, and a lower ring 5223 welded to a lower inner wall of the side wall 5222 and disposed below the flange 521; and a straight rotary rod 523 suspended from the rotary ring member 522 and adjacent to an inner wall of the funnel body 520. The rotary ring member 522 has a rough annular outer surface 5224, as shown in FIGS. 2 and 4.

The rotary ring member 522 can rotate with respect to the funnel body 520. Further, in connection with the rotary ring member 522 is a frictional belt 524 (see FIG. 4). The frictional belt 524 is provided for frictionally contacting the rough annular outer surfaces 5224 of the rotary ring members 522 so as to drive the rotary ring members 522 and hence the rotary rods 523 to rotate. With the rotation of the rotary rod 523, the solid foodstuff through the funnel 52' is prevented from attaching on the funnel 52' so that all the solid foodstuff can fully pass through the funnel 52'.

Figure 6:
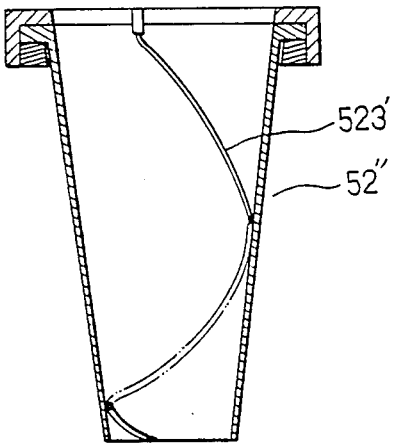
FIG. 6 is a sectional view showing another funnel of the automatic container-filling device according to the invention.

Alternatively, referring to FIG. 6, the structure of another funnel 52'' according to the invention is similar to the funnel 52' shown in FIG. 5, but the rotary rod 523' is shaped in a form of spiral rod suspended from the rotary ring member 52. Such a spiral rotary rod 523' can push the solid foodstuff downwardly to facilitate the passage of the solid foodstuff through the funnels 52''.

The operation of the flow control valve set in each solid foodstuff flow path under control of the automatic control system will be described hereinafter. For example, if it is desired that the container 61 be filled with the solid foodstuffs weighing 135 gm, it may be set that, firstly, when the weight of the solid foodstuff poured into the basket 30 reaches 120 gm the intermediate valve gate 25 is closed partly and the front valve gate 24 is opened so that the flow quantity of the solid foodstuff through the channel 20 is decreased for accurate flow control of the solid foodstuff. Subsequently, when the solid foodstuff poured into the basket 30 reaches 130 gm the rear valve gate 26 is closed so that the solid foodstuff poured into the basket 30 just reaches 135 gm due to the additional pouring of solid foodstuff at the instant of closing the rear valve gate 26. After 1.5 seconds, the front valve 24 is closed to prevent the blockage of the solid foodstuff at the intermediate valve gate 25. At the last stage of one cycle for flow control of the solid foodstuff through the channel 20, after the 135 gm of solid foodstuff has dropped into the container 61 from the basket 30 the openable bottom gate 31 is closed, while the intermediate and rear valve gates 25, 26 are opened to drop the solid foodstuff. Then when the weight of the solid foodstuff poured into the basket 30 reaches 120 gm the intermediate valve gate 25 is closed again and the front valve gate 24 is opened again to commence another cycle of flow control of the solid foodstuff. Therefore, the five baskets 30 evidently can be filled accurately with the 135 gm solid foodstuff almost simultaneously. This cycle takes only about 2.5 seconds.

As for pouring of the solid foodstuff, in the embodiment, it may be set that, when the number of the funnels 51 rotated through and detected by the counter 53 is five, that is, five of the funnels 51 arrive respectively just below the five baskets 30, a signal is output to each of the electric eyes 601. Then, if one of the containers 61 is below one of the funnels 51, a signal is output to the corresponding load cell 40, and the corresponding openable bottom gate 31 will be opened until the solid foodstuff to be poured into the corresponding basket 30 has reached a desired weight. After a predetermined time, the corresponding openable bottom gate 31 is closed. It can be understood that, if a container 61 is not below one of the funnels 51, due to sensing effect of the corresponding electric eye 601, the corresponding openable bottom gate 31 is incapable of opening. Furthermore, if the weight of the solid foodstuff filled into the basket 30 doesn't reach 135 gm in the predetermined time, the corresponding electric eye 53 will output a signal to the clutch brake 69 for stopping the rotating movement of the rotating stand 50. In case the weight of the solid foodstuff poured into the container 61 fails to reach 135 gm for a long time (e.g. 10 seconds), that is, the rotating stand 50 has stopped its rotating movement for a long time, the alarm lamp 54 will generate an audio-video alarm signal for indicating malfunction which must be repaired.

Because of the arrangement of the ribbed inner surfaces 22 of the channels 20, the net baskets 30, and the rotary rods 523, 523' of the funnels 52, 52', the solid foodstuffs of large sheets is prevented from attaching on the channels 20, the baskets 30 and the funnels 52.

Additionally, the containers 61 are vibrated slightly by the second vibrator 64 so that the containers of glass is prevented from breaking during vibration.

With the arrangement of the baskets 30 and the funnels 51 between the channels 20 and the containers 61, it is apparent that the container-filling process of solid foodstuff under control of the automatic control system is continuous and accurate.

With the invention thus explained, it is apparent that various modifications and variations can be made without departing from the scope of the invention, it is therefore intended that the invention be limited as indicated in the appended claims.

What is claimed is:

1. An automatic container-filling device for solid foodstuff comprising:

means for feeding said solid foodstuff from the exterior of the automatic container-filling device to the interior of the automatic container-filling device;

means for directing the flow of said solid foodstuff, connected to said solid foodstuff feeding means, including:

an movably mounted inclined channel for transporting said solid foodstuff fed from said solid foodstuff feeding means, including a lower outlet and a flow control valve set disposed on said channel for flow control of said solid foodstuff through said channel;

a collecting basket for collecting said solid foodstuff dropped from said outlet of said channel, including an upper opening disposed below said outlet of said channel and an openable bottom gate at a bottom of said basket;

a load cell functionally connected to said basket for measuring and indicating the weight of said solid foodstuff contained in said basket, a funnel for collecting said solid foodstuff dropped from said basket through said openable bottom gate, and a rotating stand for mounting and rotating said funnel;

a first vibrator for vibrating said channel to move said solid foodstuff downward along said channel;

means for transporting containers to beneath said funnel to receive said solid foodstuff dropped from said funnel, and subsequently transporting said containers filled with a predetermined amount of said solid foodstuff out of said automatic container-filling device; and an automatic control system, including a central processing unit CPU for controlling the action of said flow control valve, said load cell and said openable bottom gate of said basket;

whereby, said channel, said basket and said funnel form collectively a solid foodstuff flow path, and when said solid foodstuff and said containers are fed into said container-filling device, said predetermined amount of said solid foodstuff is filled respectively into each of said containers through said solid foodstuff flow path under the control of said automatic control system, and then said containers filled with said predetermined amount of said solid foodstuff will be transported out of said container-filling device.

2. An automatic container-filling device as claimed in claim 1, wherein said means for directing the flow of said solid foodstuff includes a plurality of parallel solid foodstuff flow paths to speed up the filling of said solid foodstuff into said containers.

3. An automatic container-filling device as claimed in claim 2, wherein said means for feeding said solid foodstuff includes a plurality of conveyor belts corresponding to the number of said channels for respectively feeding said solid foodstuff into said channels of said solid foodstuff flow paths.

4. An automatic container-filling device as claimed in claim 2, wherein each of said channels includes a solid foodstuff level controller thereon at a predetermined level, said solid foodstuff level controllers being responsive to an excess level of said solid foodstuff in said channel and acting to stop the movement of said conveyor belts when the level exceeds a predetermined level so as to prevent overflow of said solid foodstuff through said channels.

5. An automatic container-filling device as claimed in claim 2, wherein said means for directing the flow of said solid foodstuff includes a counter controlled by said central processing unit for detecting, totaling and indicating the number of said funnels rotated by said rotating stand to pass to a predetermined position.

6. An automatic container-filling device as claimed in claim 1, wherein said means for directing the flow of said solid foodstuff includes a clutch brake controlled by said central processing unit for stopping the rotating movement of said rotating stand when said solid foodstuff filled into any of said containers hasn't reached said predetermined amount.

7. An automatic container-filling device as claimed in claim 6, wherein said means for directing the flow of said solid foodstuff includes an alarm device for generating an alarm signal when the rotating movement of said rotating stand stops for a predetermined length of time.

8. An automatic container-filling device as claimed in claim 1, wherein said funnel comprises:

a funnel body;

a rotary ring member, sleeved on an upper opening of said funnel body, capable of rotating with respect to said funnel body;

a rotary rod, suspended from said rotary ring member along an inner wall of said funnel body for synchronous rotation with said rotary ring member to prevent said solid foodstuff from attaching to the inner wall of said funnel body.

9. An automatic container-filling device as claimed in claim 8 wherein said rotary ring member includes a rough annular outer surface, and wherein said means for directing the flow of said solid foodstuff includes a movable frictional belt for contacting frictionally said rough annular outer surface of said rotary ring member to activate said rotary ring member and hence said rotary rod to rotate.

10. An automatic container-filling device as claimed in claim 8, wherein said rotary rod is a spiral rod.

11. An automatic container-filling device as claimed in claim 8, wherein said rotary rod is a straight rod.

12. An automatic container-filling device as claimed in claim 1, wherein said channel includes a ribbed inner surface for preventing said solid foodstuff from attaching thereto when the surface area of said solid foodstuff is large.

13. An automatic container-filling device as claimed in claim 1, wherein said flow control valve set includes: a front wholly closed valve gate, an intermediate partly closed valve and a rear wholly closed valve gate; and three electro magnetic valves controlled by said central processing unit respectively electrically connected to said valve gates for controlling said valve gates; whereby, said flow control valve set can control accurately the flow quantity of said solid foodstuff through said channel.

14. An automatic container-filling device as claimed in claim 1, wherein said container feeding means includes an electric eye controlled by said central processing unit for sensing the absence of one of said containers from beneath one of said baskets to output a signal to prevent the opening of said openable bottom gate of that basket.

15. An automatic container-filling device as claimed in claim 1, wherein said baskets have a net structure for preventing said solid foodstuff from attaching thereto.

16. An automatic container-filling device as claimed in claim 1, wherein said means for directing the flow of said solid foodstuff includes a rubber piece disposed between said flow control valve set and said channell to act as cushion for vibration.

17. An automatic container-filling device as claimed in claim 1, wherein said container transporting means comprises:

a large rotating wheel, mounted securely on said rotating stand below said funnel for synchronous rotation with said funnel, having consecutive curved hemisperical indentations spaced apart equally from each other for retaining a part of said containers therein;

a spring supported vibrating plate, disposed below said large rotating wheel, having a smooth upper surface for placing said containers thereon;

a second vibrator for vibrating said vibrating plate; and a container block rod, surrounding said large rotating wheel above said vibrating plate in cooperation with said indentations of said large rotating wheel for holding said containers to receive said solid foodstuff dropped from said funnel.

18. An automatic container-filling device as claimed in claim 17, wherein said container transporting means further includes a container input small rotating wheel and a container output small rotating wheel, said two small rotating wheels having consecutive curved indentations spaced apart equally from each other for retaining a part of said containers for respectively inputing and outputing of said containers in and out of the device.

* * * * *